US005724848A

United States Patent [19]

Aschberger

[11] Patent Number: 5,724,848

[45] Date of Patent: Mar. 10, 1998

[54] SYSTEM AND PROCESS FOR NECKING CONTAINERS

[75] Inventor: Anton A. Aschberger, Downers Grove, Ill.

[73] Assignee: Crown Cork & Seal Company, Inc., Philadelphia, Pa.

[21] Appl. No.: 759,189

[22] Filed: Dec. 4, 1996

Related U.S. Application Data

[63] Continuation of Ser. No. 636,040, Apr. 22, 1996, abandoned.

[51] Int. Cl.[6] ..... B21D 22/00; B21D 22/21

[52] U.S. Cl. ..... 72/356; 72/348; 413/69

[58] Field of Search ..... 72/348, 349, 354.2, 72/354.6, 356, 370, 379.4; 413/69, 76

[56] References Cited

U.S. PATENT DOCUMENTS

| | | | |
|---|---|---|---|
| 3,786,957 | 1/1974 | Hilgenbrink | 220/83 |
| 3,983,729 | 10/1976 | Traczyk et al. | 72/43 |
| 4,173,883 | 11/1979 | Boik | 72/354 |
| 4,392,764 | 7/1983 | Kubis et al. | 413/69 |
| 4,403,493 | 9/1983 | Atkinson | 72/356 |
| 4,774,839 | 10/1988 | Caleffi et al. | 72/354 |
| 5,199,596 | 4/1993 | Saunders | 220/604 |
| 5,297,414 | 3/1994 | Sainz | 72/354.6 |
| 5,355,710 | 10/1994 | Diekhoff | 72/379.4 |
| 5,497,900 | 3/1996 | Caleffi et al. | 220/656 |

FOREIGN PATENT DOCUMENTS 0118 926 A1 9/1984 European Pat. Off. .

*Primary Examiner*—Daniel Moon
*Assistant Examiner*—Rodney Butler
*Attorney, Agent, or Firm*—Woodcock Washburn Kurtz Mackiewicz & Norris LLP

[57] ABSTRACT

An improved system and process of necking an upper end of a metallic container that will reduce the incidence of defects such as wrinkles and puckers during the necking process includes steps of performing a first stage operation to reduce a radius of said upper end by a first distance, and incrementally further reducing the radius of the upper end by performing a plurality of subsequent reduction operations on the upper end. Advantageously, step (b) is performed so that the amount of radius reduction that is applied by earlier of the subsequent reduction operations is less than the amount of radius reduction that is applied by later of the subsequent reduction operations. As a result, increases of wall thickness that occur during the subsequent reduction operations will be utilized to permit greater radial reduction in the later steps, and will ease the amount of radial reduction in the earlier steps, reducing the potential for defects such as puckering and wrinkling.

7 Claims, 3 Drawing Sheets

SYSTEM AND PROCESS FOR NECKING CONTAINERS

This is a continuation of application Ser. No. 08/636,040, filed Apr. 22, 1996, now abandoned.

BACKGROUND OF THE INVENTION

1. Field of the Invention

This invention relates broadly to the field of metallic containers, such as the two-piece cans that are used for packaging beverages such as soft drinks and juices. More specifically, this invention relates to an improved process and system for necking metallic containers that will result in fewer defects and in more efficient manufacturing than was heretofore thought possible.

2. Description of the Prior Art

Two piece metal containers such as those manufactured by the assignee of this invention, Crown Cork & Seal Company, are in common use throughout the world for packing beverages and other goods. In forming a two-piece container, a metal blank is impact extruded or deep drawn to produce a cylindrical body and an integral bottom end wall. The second piece of the two-piece container consists of an end panel that is separately formed and attached to the upper end of the cylindrical body by a double seaming process.

Initially, containers manufactured according to this process had a larger outside diameter along the upper edge where the double seaming operation has been performed than the diameter of the remainder of the container. When cans such as these were placed in a multi-pack carrier, such as a so-called six-pack carton which grips the upper double seam, the package, when viewed from the end, would be slightly trapezoidal in shape. To overcome this problem, as well as to reduce the diameter of the can ends being applied in order to save material, most two-piece beverage containers are now being manufactured with a reduced diameter neck portion that is produced on the upper free edge of the integral body and bottom wall so that when a double seam is formed, the outer edges of the seam are approximately parallel or flush with the outer peripheral surface of the remainder of the can body. This provides a more compact packing of cans which in turn lowers the total shipping and storage costs. Because of the reduced cost and the pleasing esthetics of these types of containers, the demand for containers of this type is substantial and is continually increasing.

Typically, the reduction or necking process is performed incrementally by passing the open end of the can body through a number of reduction dies, each successive reduction die reforming the necked area to a slightly smaller diameter. As discussed in U.S. Pat. No. 5,355,710 to Diekhoff, the reduction increment from one die to the next was preferably kept constant throughout the entire process.

During the reduction or necking process, defects called "puckers" and other local failures can occur in the neck area. Misblends can also cause wrinkles in the neck. In the past, efforts to minimize such defects involved lessening the reduction increment from die to die (which required more operations to achieve the desired reduction), changing the clearance between the die and the support tool, and increasing the accuracy by which the can body is positioned for each step. Although such efforts have proved successful to some extent, better results are being sought. In particular, there is an need for any improvements that will decrease the number of operations that are necessary to achieve the desired reduction and not increase defects, or that will reduce the number of defects when compared to systems and processes heretofore known.

SUMMARY OF THE INVENTION

Accordingly, it is an object of the invention to provide an improved process and system for decreasing the number of operations that are necessary to achieve the desired reduction in a necking system and not increase defects, or that will reduce the number of defects when compared to systems and processes heretofore known.

In order to achieve the above and other objects of the invention, a process of incrementally necking an upper end of a metallic container that has a first radius includes, according to a first aspect of the invention, steps of die pressing the upper end of the metallic container so the upper end is reformed to a second radius, the second radius being less than the first radius by a first distance; and then die pressing the upper end of the metallic container so the upper end is reformed to a third radius that is less than the second radius by a second distance, and wherein the second distance is greater than the first distance, whereby the process is performed in steps that increase in the amount of radial reduction that is applied, rather than in equal amounts of reduction as has heretofore been conventional.

According to a second aspect of the invention, a process of incrementally necking an upper end of a metallic container includes steps of performing a first stage operation to reduce a radius of the upper end by a first distance; performing a first subsequent operation that is subsequent to the first operation to reduce the radius of the upper end by a second distance; performing a second subsequent operation that is subsequent to the first subsequent operation to reduce the radius of the upper end by a third distance; and performing a third subsequent operation that is subsequent to the second subsequent operation to reduce the radius of the upper end by a fourth distance, and wherein the third distance is larger than the second distance and the fourth distance is larger than the third distance, whereby the increments of reduction become larger as the radius of the can end becomes smaller and wall thickness increases.

An improved process of necking an upper end of a metallic container that will reduce the incidence of defects such as wrinkles and puckers during the necking process, according to a third aspect of the invention steps of performing a first stage operation to reduce a radius of the upper end by a first distance; and incrementally further reducing the radius of the upper end by performing a plurality of subsequent reduction operations on the upper end, this second step being performed so that the amount of radius reduction that is applied by earlier of the subsequent reduction operations is less than the amount of radius reduction that is applied by later of the subsequent reduction operations, whereby increases of wall thickness that occur during the subsequent reduction operations will be utilized to permit greater radial reduction in the later steps, and will ease the amount of radial reduction in the earlier steps when compared to processes heretofore known or practiced.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
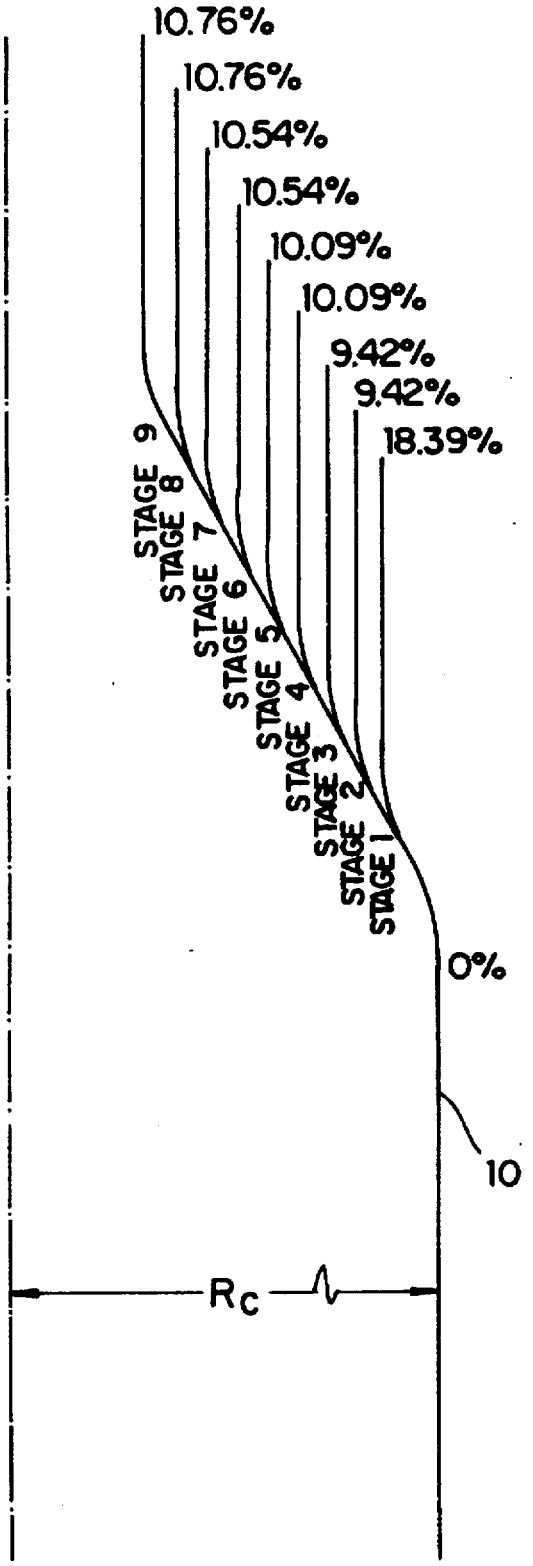
FIG. 1 is a diagrammatical depiction of a necking process that is performed according to a first embodiment of the invention.
Figure 2:
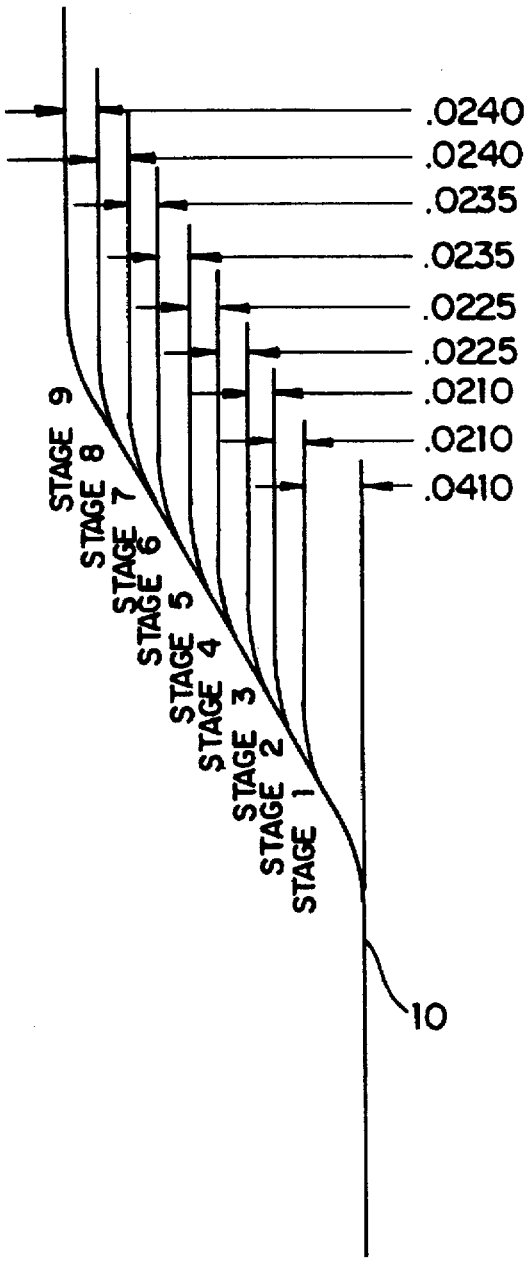
FIG. 2 is a diagrammatical depiction of the necking process shown in FIG. 1.
Figure 5:
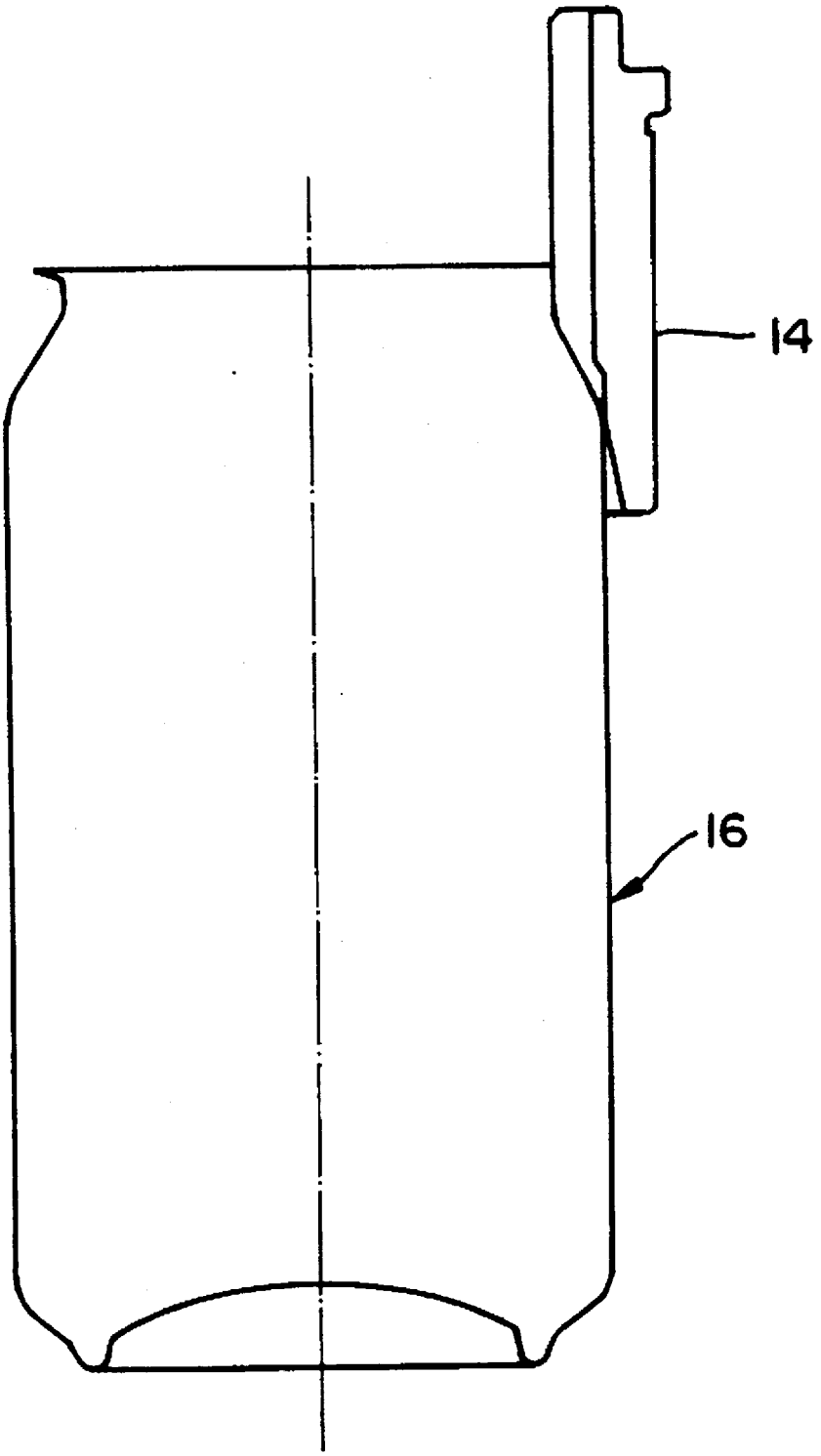
FIG. 5 is a diagrammatical view of a system for performing the processes which are depicted in FIGS. 1–4.

Referring now to the drawings, wherein like reference numerals designate corresponding structure throughout the views, and referring in particular to FIGS. 1 and 2, a preferred first embodiment of a process of incrementally necking an upper end 10 of a metallic container that has a first radius $R_c$ will be performed by an otherwise conventional necking die assembly 14 on a can body 16, as is diagrammatically depicted in FIG. 5.

Figure 3:
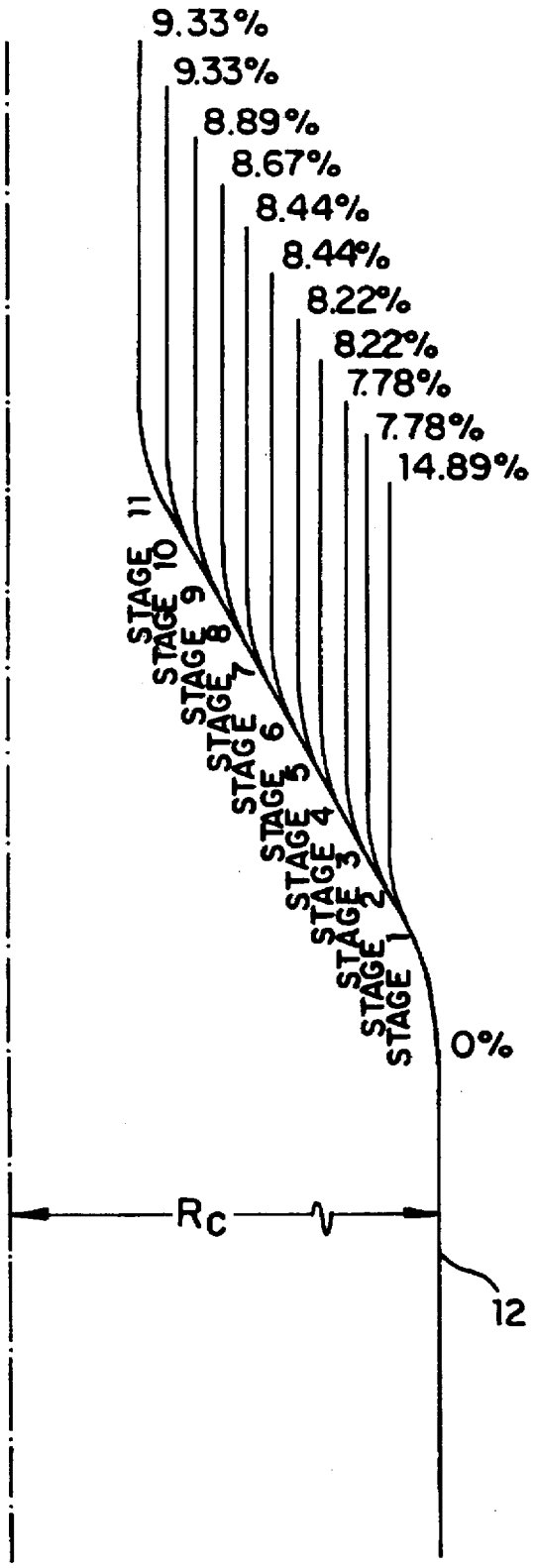
FIG. 3 is a diagrammatical depiction of a necking process that is performed according to a second embodiment of the invention.
Figure 4:
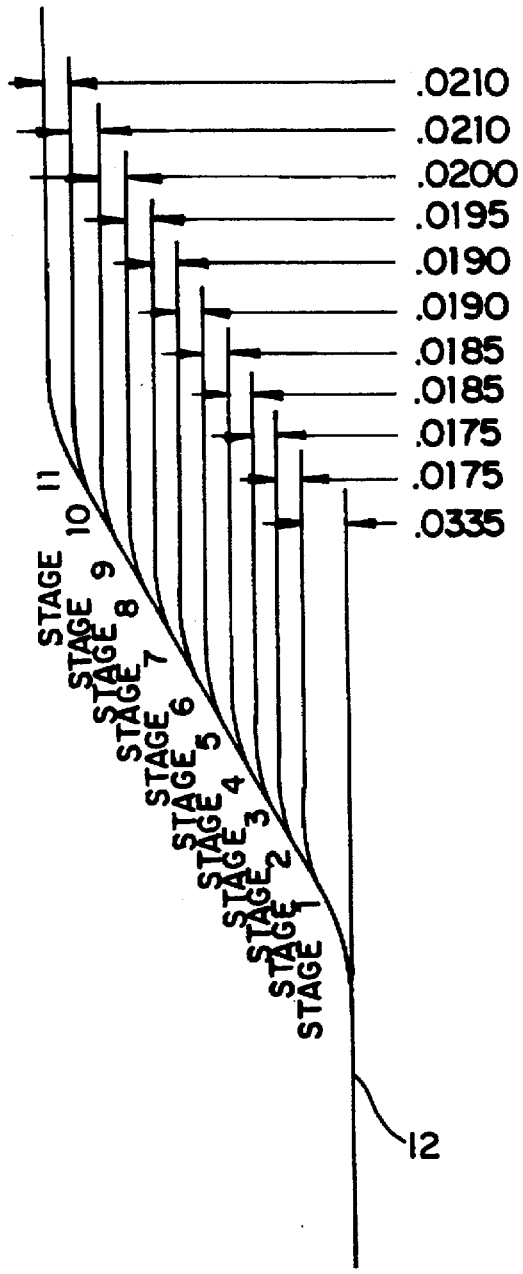
FIG. 4 is a diagrammatical depiction of the necking process shown in FIG. 3.

A process according to the invention which is performed in accordance with the embodiments of FIGS. 1 and 2 will be a nine stage process, meaning that there are nine separate stages of radial reduction that are applied to the upper end 10 of the metallic container in order to reach the desired final configuration. In the embodiment that is depicted in FIGS. 3 and 4, an eleven stage process is shown, meaning that there are eleven separate stages of reduction to achieve the desired final configuration. Common to both embodiments is the step of performing a first stage operation to reduce a radius $R_c$ of the upper end 10 of the metallic container by a first distance, in order to begin the necking process. In the embodiment of FIGS. 1 and 2, this first stage operation reduces the radius $R_c$ by a distance that is approximately 0.0410 inches, which is about 18.39% of the entire diametrical reduction that is to be visited upon the can body during the entire process. In the process that is depicted diagrammatical in FIGS. 3 and 4, the first stage will effect a radial reduction of approximately 0.0335 inches, which is about 14.89% of the total reduction that will be applied to the upper end 12 of the metallic container. As is known in the industry, the first stage operation is larger because it must form both an outer and an inner bend radius.

After the first stage operation is performed, a number of incremental subsequent operations must be performed to reform the upper end 10 of the metallic container to its desired final configuration. In the embodiment that is performed as shown in FIGS. 1 and 2, this is achieved by incrementally reducing the radius of the upper end 10 by eight different operations that are given the appellations "STAGE TWO" to "STAGE NINE". In the embodiment shown in FIGS. 3 and 4, the subsequent operations, of which there ten, are labeled "STAGE TWO" through "STAGE ELEVEN".

According to one very important aspect of the invention, these subsequent reduction operations that are performed on the upper end 10 of the metallic container are categorized such that the amount of radius reduction that is applied by earlier of the subsequent reduction operations is less than the amount of radius reduction that is applied by later of the reduction operations. As a result, increases in wall thickness that occur during the initial reduction operations will be utilized to permit greater radial reduction in the later steps, which will ease the amount of radial reduction that is necessary in the earlier steps to achieve a desired final configuration. This easing of the magnitude of reduction in the earlier operations reduces the likelihood of wrinkling and pucking that might otherwise occur in earlier reduction steps.

In the embodiment shown in FIGS. 1 and 2, the STAGE TWO and STAGE THREE reductions are approximately 0.0210 inches, which constitute approximately 9.42% of the total desired radial reduction. STAGE FOUR and STAGE FIVE operations in this embodiment result in a radial reduction that is, for each operation, approximately 0.0225 inches, or about 10.09% of the final desired radial reduction. The STAGE SIX and STAGE SEVEN are greater, approximately 0.0235 inches or about 10.54% of the total desired reduction. The final two stages, which are STAGES EIGHT and NINE, are given in this embodiment radial reduction values of approximately 0.0240 inches, or about 10.76% of the total radial reduction.

In the embodiment of the invention that is shown in FIGS. 3 and 4, STAGES TWO and THREE constitute a radial reduction of approximately 0.0175 inches, or about 7.78% of the total desired reduction. The THIRD and FOURTH STAGES give a radial reduction of approximately 0.0185 inches, or about 8.22% of the final desired reduction. The SIXTH and SEVENTH reduction are approximately 0.0190 inches, which is approximately 8.44% of the desired overall reduction, while the STAGE SEVEN reduction is approximately 0.0195 inches, or about 8.76% of the total desired reduction. The EIGHTH STAGE reduction is approximately 0.0200 inches, or about 8.89% of the final desired reduction, while the TENTH and ELEVENTH STAGES are each of about approximately 0.0210 inches, or about 9.33% of the total desired reduction.

Conceptually, than, it may be said that one way to express one aspect of the invention is that, after the FIRST STAGE operation is performed, a first subsequent operation is performed to reduce the radius of the upper end by a second distance, and then a second subsequent operation is performed to reduce the radius of the upper end by a third distance. A third subsequent operation is than performed subsequent to the second subsequent operation to reduce the radius of the upper end by a fourth distance, and the third distance is larger than the second distance, and the fourth distance is larger than the third distance, so that the increments of reduction become larger as the radius of the can end become smaller and wall thickness increases.

An aspect of the invention that occurs within the subsequent operation steps may be expressed as pressing the upper end of the metallic container 10 so that the upper end is preformed to a second radius that is less than an initial radius $R_c$ of the can body. This characterization of the invention would further include a step of, after the first step, by pressing the upper end of the metallic container so that the upper end is reformed to a third radius that is less than the second radius by a second distance, wherein the second distance is greater than the first distance so that the process is performed in steps that increase in the amount of radial reduction that is applied, rather than in equal amounts of reduction as as heretofore been conventional.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A process of incrementally necking an upper end of a metallic container that has a first radius, comprising steps of:

(a) die pressing the upper end of the metallic container so the upper end is reformed to a second radius, the second radius being less than the first radius by a first distance; and (b) after step (a), die pressing the upper end of the metallic container so the upper end is reformed to a third radius that is less than the second radius by a second distance, and wherein said second distance is greater than said first distance, whereby the process is performed in steps that increase in the amount of radial reduction that is applied, rather than in equal amounts of reduction as has heretofore been conventional.

2. A process according to claim 1, wherein step (a) takes place after a first stage reduction of said upper end.

3. A process according to claim 1, further comprising:

(c) after step (b), die pressing the upper end of the metallic container so that the upper end is radially reduced by a third distance that is greater than said second distance, whereby the increments of reduction become larger as the radius of the can end becomes smaller and wall thickness increases.

4. A process of incrementally necking an upper end of a metallic container, comprising steps of:

(a) performing a first stage operation to reduce a radius of said upper end by a first distance;

(b) performing a first subsequent operation that is subsequent to said first operation to reduce the radius of said upper end by a second distance;

(c) performing a second subsequent operation that is subsequent to said first subsequent operation to reduce the radius of said upper end by a third distance; and (d) performing a third subsequent operation that is subsequent to said second subsequent operation to reduce the radius of said upper end by a fourth distance, and wherein said third distance is larger than said second distance and said fourth distance is larger than said third distance, whereby the increments of reduction become larger as the radius of the can end becomes smaller and wall thickness increases.

5. A process according to claim 4, wherein said process includes nine stages of radial reduction, and said second distance in step (b) represents less than about 10% of the total radial reduction that is imparted to the can end during the entire process.

6. A process according to claim 5, wherein said second distance in step (b) represents about 9.0 to about 9.8% of the total radial reduction that is imparted to the can end during the entire process.

7. An improved process of necking an upper end of a metallic container that will reduce the incidence of defects such as wrinkles and puckers during the necking process, comprising steps of:

(a) performing a first stage operation to reduce a radius of said upper end by a first distance; and (b) incrementally further reducing the radius of the upper end by performing a plurality of subsequent reduction operations on the upper end, wherein step (b) is performed so that the amount of radius reduction that is applied by earlier of said subsequent reduction operations is less than the amount of radius reduction that is applied by later of said subsequent reduction operations, whereby increases of wall thickness that occur during the subsequent reduction operations will be utilized to permit greater radial reduction in the later steps, and will ease the amount of radial reduction in the earlier steps when compared to processes heretofore known or practiced.

* * * * *

UNITED STATES PATENT AND TRADEMARK OFFICE

CERTIFICATE OF CORRECTION

PATENT NO. : 5,724,848

DATED : March 10, 1998

INVENTOR(S) : Aschberger

It is certified that error appears in the above-indentified patent and that said Letters Patent is hereby corrected as shown below:

Column 1, Line 65, delete "there is an need for" and insert --there is a need for-- therefor.

Column 4, Line 38, delete "Conceptually, than, it may be said" and insert --Conceptually, then, it may be said--.

Column 4, Line 44, delete "operation is than performed" and insert --operation is then performed--.

Column 4, Line 63, delete "reduction as as heretofore" and insert --reduction as has heretofore-- therefor.

Signed and Sealed this

Sixteenth Day of June, 1998

*Attest:*

*Attesting Officer*

BRUCE LEHMAN

*Commissioner of Patents and Trademarks*